US010883745B2

(12) United States Patent
Higashiiue et al.

(10) Patent No.: US 10,883,745 B2
(45) Date of Patent: Jan. 5, 2021

(54) REFRIGERATION CYCLE APPARATUS

(71) Applicant: Mitsubishi Electric Corporation, Tokyo (JP)

(72) Inventors: Shinya Higashiiue, Tokyo (JP); Ryota Akaiwa, Tokyo (JP); Shin Nakamura, Tokyo (JP); Yohei Kato, Tokyo (JP); Tsubasa Tanda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 48 days.

(21) Appl. No.: 16/094,533

(22) PCT Filed: Jun. 27, 2016

(86) PCT No.: PCT/JP2016/068971
§ 371 (c)(1),
(2) Date: Oct. 18, 2018

(87) PCT Pub. No.: WO2018/002983
PCT Pub. Date: Jan. 4, 2018

(65) Prior Publication Data

US 2019/0137146 A1 May 9, 2019

(51) Int. Cl.
*F25B 5/04* (2006.01)
*F25B 40/06* (2006.01)
(Continued)

(52) U.S. Cl.
CPC ..... *F25B 5/04* (2013.01); *F25B 13/00* (2013.01); *F25B 39/028* (2013.01); *F25B 40/06* (2013.01);
(Continued)

(58) Field of Classification Search
CPC ..... F25B 5/04; F25B 47/006; F25B 39/028; F25B 13/00; F25B 40/06; F25B 47/022;
(Continued)

(56) References Cited

U.S. PATENT DOCUMENTS 5,063,752 A * 11/1991 Nakamura ..... F24F 3/065 62/160
2011/0132585 A1* 6/2011 Chen ..... F28F 9/026 165/152
(Continued)

FOREIGN PATENT DOCUMENTS

CN 203785346 U 8/2014
CN 104566678 A 4/2015
(Continued)

OTHER PUBLICATIONS

Extended EP Search Report dated Apr. 23, 2019 issued in corresponding EP patent application No. 16907216.2.
(Continued)

*Primary Examiner* — Frantz F Jules
*Assistant Examiner* — Lionel Nouketcha
(74) *Attorney, Agent, or Firm* — Posz Law Group, PLC

(57) ABSTRACT

A refrigeration cycle apparatus includes a refrigerant circuit which allows refrigerant to circulate therethrough, and an outdoor heat exchanger which exchanges heat between the refrigerant and outdoor air. The outdoor heat exchanger has first to third heat exchange sections. The second heat exchange section is located below the first heat exchange section, and the third heat exchange section is located below the second heat exchange section. In a refrigerant passage connecting the second and third heat exchange sections, a first pressure reducing device reduces a pressure of the refrigerant flowing through the refrigerant passage. In an operation mode in which the first and second heat exchange sections each serve as an evaporator, the third heat exchange section is located upstream of the second heat exchange section in the flow of the refrigerant, and refrigerant having a temperature higher than that of the outdoor air flows through the third heat exchange section.

7 Claims, 9 Drawing Sheets

(51) Int. Cl.

| | |
|---|---|
| ***F25B 13/00*** | (2006.01) |
| ***F25B 41/04*** | (2006.01) |
| ***F25B 47/02*** | (2006.01) |
| ***F28D 1/04*** | (2006.01) |
| ***F25B 39/02*** | (2006.01) |
| ***F25B 47/00*** | (2006.01) |

(52) U.S. Cl.
CPC ..... *F25B 41/04* (2013.01); *F25B 47/006* (2013.01); *F25B 47/022* (2013.01); *F28D 1/0443* (2013.01); *F25B 2313/0251* (2013.01); *F25B 2341/0662* (2013.01); *F25B 2400/0409* (2013.01); *F25B 2400/0411* (2013.01); *F25B 2500/06* (2013.01)

(58) Field of Classification Search
CPC ..... F25B 2341/0662; F25B 2313/0251; F25B 2400/0409; F28D 1/0443
See application file for complete search history.

(56) References Cited

U.S. PATENT DOCUMENTS

| | | | | |
|---|---|---|---|---|
| 2013/0091882 | A1* | 4/2013 | Cho | F25B 47/022 62/156 |
| 2015/0053384 | A1 | 2/2015 | Ishibashi et al. | |
| 2015/0083377 | A1 | 3/2015 | Jindou et al. | |
| 2015/0107286 | A1* | 4/2015 | Jin | F25B 5/04 62/222 |
| 2017/0343289 | A1 | 11/2017 | Jindou et al. | |
| 2017/0343290 | A1 | 11/2017 | Jindou et al. | |

FOREIGN PATENT DOCUMENTS

| | | | | | |
|---|---|---|---|---|---|
| EP | 2 980 510 | A1 | | 2/2016 | |
| JP | S57-179073 | U | | 11/1982 | |
| JP | 61052564 | A | * | 3/1986 | |
| JP | S61-52564 | A | | 3/1986 | |
| JP | S57179073 | U | * | 11/1992 | |
| JP | 2002-372320 | A | | 12/2002 | |
| JP | 2002372320 | A | * | 12/2002 | |
| JP | 2008-121997 | A | | 5/2008 | |
| JP | 2013-231535 | A | | 11/2013 | |
| JP | 2015-081765 | A | | 4/2015 | |
| JP | 2015-183976 | A | | 10/2015 | |
| WO | 2013/160956 | A1 | | 10/2013 | |
| WO | 2014/155816 | A1 | | 10/2014 | |
| WO | WO-2014155816 | A1 | * | 10/2014 | F25B 41/067 |

OTHER PUBLICATIONS

International Search Report of the International Searching Authority dated Sep. 13, 2016 for the corresponding International application No. PCT/JP2016/068971 (and English translation).
Office Action dated Jul. 16, 2019 issued in corresponding JP patent application No. 2018-524594 (and English translation).
Office Action dated Jan. 21, 2020 issued in corresponding JP patent application No. 2018-524594 (and English translation).
Office Action dated Apr. 3, 2020 issued in corresponding CN patent application No. 201680086642.5 (and English translation).

* cited by examiner

REFRIGERATION CYCLE APPARATUS

CROSS REFERENCE TO RELATED APPLICATION

This application is a U.S. national stage application of PCT/JP2016/068971 filed on Jun. 27, 2016, the disclosure of which is incorporated herein by reference.

TECHNICAL FIELD

The present invention relates to a refrigeration cycle apparatus including an outdoor heat exchanger.

BACKGROUND ART

Patent Literature 1 discloses an outdoor heat exchanger including a plurality of flat tubes, a first header collecting pipe connected to one of the ends of each of the flat tubes, and a second header collecting pipe connected to the other end of each flat tube. In the outdoor heat exchanger, an upper heat exchange region serves as a main heat exchange region, and a lower heat exchange region serves as an auxiliary heat exchange region. The main heat exchange region is divided into a plurality of main heat exchange sections, and the auxiliary heat exchange region is divided into a plurality of auxiliary heat exchange sections the number of which is equal to that of the main heat exchange sections. In the case where the outdoor heat exchanger serves as a condenser, high-pressure gas refrigerant flows into each of the main heat exchange sections. In each main heat exchange section, the gas refrigerant transfers heat to outdoor air and thus condenses. The refrigerant which has condensed in each main heat exchange section further transfers heat to the outdoor air in the auxiliary heat exchange sections, which are associated with the main heat exchange sections, and the refrigerant is thus subcooled. In the case where the outdoor heat exchanger serves as an evaporator, two-phase refrigerant flows into each of the auxiliary heat exchange sections. In each auxiliary heat exchange section, the refrigerant receives heat from the outdoor air, and as a result part of liquid refrigerant evaporates. After flowing out of each auxiliary heat exchange section, the refrigerant further receives heat from the outdoor air in the main heat exchange sections, which are associated with the auxiliary heat sections, and as a result the refrigerant evaporates to change into single-phase gas refrigerant.

CITATION LIST

Patent Literature

Patent Literature 1: Japanese Unexamined Patent Application Publication No. 2013-231535

SUMMARY OF INVENTION

Technical Problem

In the case where a heating operation is performed in a refrigeration cycle apparatus including the outdoor heat exchanger disclosed in Patent Literature 1, the outdoor heat exchanger serves as an evaporator. Thus, when the temperature of outdoor air is low, moisture in the air deposits as frost on fins included in the main heat exchange sections and the auxiliary heat exchange sections. The frost on the fins inhibits heat exchange in the outdoor heat exchanger. Therefore, a defrosting operation for melting frost by causing high-pressure gas refrigerant to flow into the outdoor heat exchanger is periodically performed. Water obtained by melting the frost in the defrosting operation collects at lower part of the outdoor heat exchanger. In this state, if the heating operation is resumed, there is a possibility that the lower part of the outdoor heat exchanger will freeze, causing breakage of the outdoor heat exchanger.

The present invention has been made to solve the above problem, and aims to provide a refrigeration cycle apparatus which can prevent breakage of an outdoor heat exchanger.

Solution to Problem

A refrigeration cycle apparatus according to an embodiment of the present invention includes a refrigerant circuit which allows refrigerant to circulate therethrough, and an outdoor heat exchanger which is provided to the refrigerant circuit, and exchanges heat between the refrigerant and outdoor air. The outdoor heat exchanger has a first heat exchange section, a second heat exchange section, and a third heat exchange section. The second heat exchange section is located below the first heat exchange section, and is connected to the first heat exchange section. The third heat exchange section is located below the second heat exchange section, and is connected to the second heat exchange section. The apparatus further includes a first pressure reducing device provided at a refrigerant passage which connects the second heat exchange section and the third heat exchange section. The first pressure reducing device reduces a pressure of the refrigerant flowing through the refrigerant passage. The third heat exchange section is located at a position more upstream than a position of the second heat exchange section in a refrigerant circulating direction in an operation mode in which the first heat exchange section and the second heat exchange section each serve as an evaporator, and the refrigerant having a temperature higher than that of the outdoor air flows through the third heat exchange section.

Advantageous Effects of Invention

According to an embodiment of the present invention, refrigerant having a temperature higher than that of outdoor air flows through a third heat exchange section located below a first heat exchange section and a second heat exchange section in an operation mode in which the first and second heat exchange sections each serve as an evaporator, Thereby, it is possible to prevent lower part of an outdoor heat exchanger from freezing even if the above operation mode is resumed under a condition where water formed by melting frost or defrosting stays in the third heat exchange section. Thus, the outdoor heat exchanger can be prevented from being broken.

DESCRIPTION OF EMBODIMENTS

Embodiment 1

Figure 1:
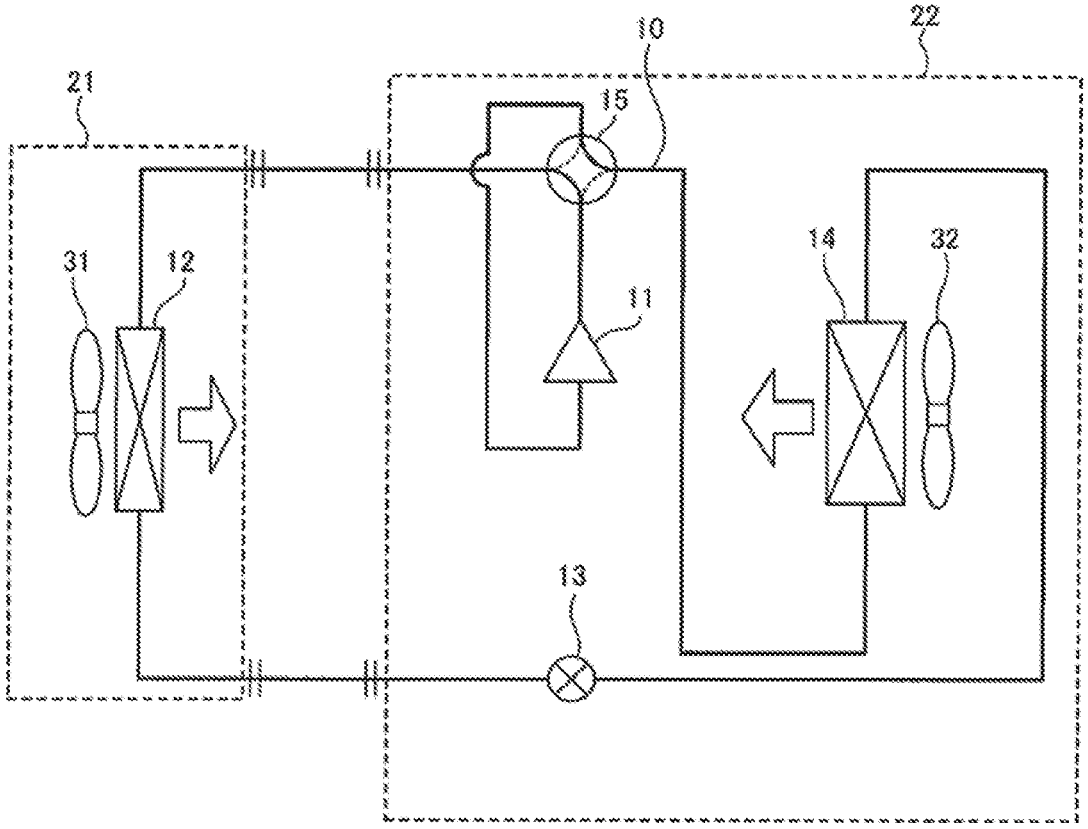
FIG. 1 is a schematic refrigerant-circuit diagram illustrating a configuration of a refrigeration cycle apparatus according to embodiment 1 of the present invention.

A refrigeration cycle apparatus according to embodiment 1 of the present invention will be described. FIG. 1 is a schematic refrigerant-circuit diagram illustrating a configuration of the refrigeration cycle apparatus according to embodiment 1. It should be noted that the relationship in dimension and shape between components as illustrated in the following drawings including FIG. 1 may differ from that between the actual components. The positional relationship between the components (for example, a vertically positional relationship) described in the following, in principle, corresponds to that in the case where the refrigeration cycle apparatus is installed usable.

As illustrated in FIG. 1, the refrigeration cycle apparatus includes a refrigerant circuit 10 which allows refrigerant to circulate therethrough. The refrigerant circuit 10 includes a compressor 11, a flow switching device 15, an indoor heat exchanger 12, a pressure reducing device 13, and an outdoor heat exchanger 14, which are connected by refrigerant pipes. The refrigeration cycle apparatus further includes an outdoor unit 22 installed in, for example, an outdoor space, and an indoor unit 21 installed in, for example, an indoor space. The outdoor unit 22 includes the compressor 11, the flow switching device 15, the pressure reducing device 13, the outdoor heat exchanger 14 and an outdoor-air sending fan 32 which sends outdoor air to the outdoor heat exchanger 14. The indoor unit 21 includes the indoor heat exchanger 12 and an indoor-air sending fan 31 which sends indoor air to the indoor heat exchanger 12.

The compressor 11 is fluid machinery which compresses sucked low-pressure refrigerant into high-pressure refrigerant, and discharges the high-pressure refrigerant. The flow switching device 15 switches a passage for refrigerant in the refrigerant circuit 10 between a passage for a cooling operation and a passage for a heating operation in the refrigerant circuit 10. As the flow switching device 15, for example, a four-way valve is used. In the cooling operation, the passage in the flow switching device 15 is switched to a passage indicated by solid lines in FIG. 1. In the heating operation, the passage in the flow switching device 15 is switched to a passage indicated by broken lines in FIG. 1. The indoor heat exchanger 12 is a load-side heat exchanger which serves as an evaporator in the cooling operation, and serves as a radiator (e.g., a condenser) in the heating operation. In the indoor heat exchanger 12, refrigerant flowing therethrough exchanges heat with indoor air supplied by the indoor-air sending fan 31.

The pressure reducing device 13 reduces the pressure of high-pressure refrigerant. As the pressure reducing device 13, for example, an electronic expansion valve whose opening degree can be adjusted under the control by a controller is used. The outdoor heat exchanger 14 is a heat-source-side heat exchanger which serves mainly as a radiator (e.g., a condenser) in the cooling operation, and serves mainly as an evaporator in the heating operation. In the outdoor heat exchanger 14, refrigerant flowing therethrough exchanges heat with outdoor air supplied by the outdoor-air sending fan 32.

The controller (not illustrated) includes a microcomputer including a central processing unit (CPU), a read-only memory (ROM), a random access memory (RAM), an input-output (I/O) port, a timer, etc. The controller controls an operation of the entire refrigeration cycle apparatus including the compressor 11, the pressure reducing device 13, the flow switching device 15, the indoor-air sending fan 31 and the outdoor-air sending fan 32 on the basis of detection signals from a temperature sensor which detects a temperature of the refrigerant and a pressure sensor which detects a pressure of the refrigerant. The controller may be provided in the outdoor unit 22 or in the indoor unit 21. Furthermore, the controller may include an outdoor-unit control unit, which is provided in the outdoor unit 22, and an indoor-unit control unit, which is provided in the indoor unit 21, and which is capable of communicating with the outdoor-unit control unit.

Figure 2:
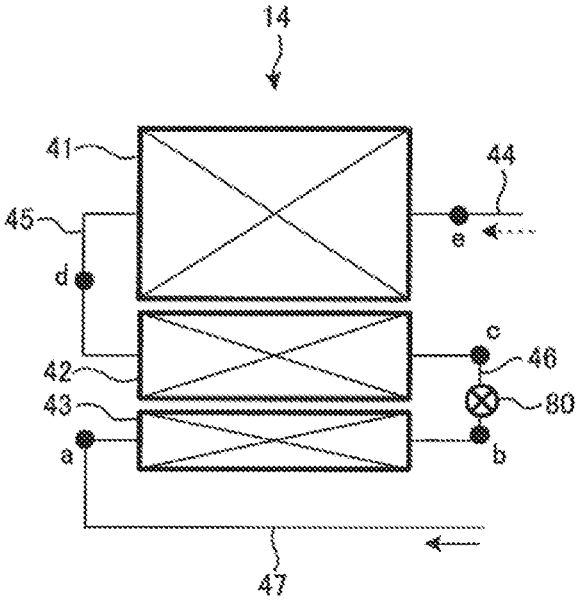
FIG. 2 is a schematic front view illustrating a configuration of an outdoor heat exchanger 14 in embodiment 1 of the present invention.

FIG. 2 is a schematic front view illustrating a configuration of the outdoor heat exchanger 14 in embodiment 1. The outdoor heat exchanger 14 includes a plurality of heat transfer tubes extending laterally and a plurality of plate-like fins intersecting the heat transfer tubes. As each of the heat transfer tubes, a flat multi-hole tube or a small-diameter tube (e.g., a cylindrical tube) having an inside diameter of 6 mm or less is used. The outdoor heat exchanger 14 may include a pair of header collecting pipes connected to both ends of each of the heat transfer tubes.

As illustrated in FIG. 2, the outdoor heat exchanger 14 has a heat exchange region divided into three heat exchange sections vertically arranged parallel to each other. The outdoor heat exchanger 14 includes a first heat exchange section 41 which corresponds to the uppermost one of the three heat exchange section, a second heat exchange section 42 which is located below the first heat exchange section 41, and a third heat exchange section 43 which is located below the second heat exchange section 42 and corresponds to the lowermost one of the heat exchange sections. In embodiment 1, the first heat exchange section 41, the second heat exchange section 42 and the third heat exchange section 43 are regions into which the heat exchange region of the single outdoor heat exchanger 14 are separated. Therefore, in terms of structure, the first heat exchange section 41, the second heat exchange section 42 and the third heat exchange section 43 are provided as a single body.

The first heat exchange section 41, the second heat exchange section 42, and the third heat exchange section 43 are connected in series to each other in a refrigerant circulating direction in the refrigerant circuit 10, The first heat exchange section 41 is connected to a discharge side or a suction side of the compressor 11 by a refrigerant passage 44 which is defined by a header of the outdoor heat exchanger 14, a refrigerant pipe, the flow switching device 15, etc. The first heat exchange section 41 is connected to the second heat exchange section 42 by a refrigerant passage 45 defined by a header, a refrigerant pipe, etc. The second heat exchange section 42 and the third heat exchange section 43 are connected to each other by a refrigerant passage 46 defined by a header, a refrigerant pipe, etc. The third heat exchange section 43 is connected to the pressure reducing device 13 or the indoor heat exchanger 12 by a refrigerant passage 47 defined by a header, a refrigerant pipe, etc.

In the cooling operation, the refrigerant discharged from the compressor 11 flows, as indicated by a dashed arrow in FIG. 2, through the first heat exchange section 41, the second heat exchange section 42 and the third heat exchange section 43 in this order. In the heating operation, the refrigerant to be sucked into the compressor 11 flows, as indicated by a solid arrow in FIG. 2, through the third heat exchange section 43, the second heat exchange section 42 and the first heat exchange section 41 in this order.

In the refrigerant passage 46 between the second heat exchange section 42 and the third heat exchange section 43, a flow control device 80 is provided as a pressure reducing device which reduces the pressure of refrigerant which flows through the refrigerant passage. As the flow control device 80, for example, an electronic expansion valve to be controlled by the controller is used.

For example, in the heating operation, an opening degree of the flow control device 80 is adjusted such that the degree of superheat of refrigerant at an outlet (point e in FIG. 2) of the first heat exchange section 41 is made closer to a preset target value. The degree of superheat of the refrigerant at the outlet of the first heat exchange section 41 is calculated based on a detection value obtained by the temperature sensor which detects a temperature of the refrigerant at the outlet of the first heat exchange section 41 and a detection value obtained by the pressure sensor which detects a saturation temperature of the refrigerant at the outlet of the first heat exchange section 41. Instead of the pressure sensor, a temperature sensor which detects a temperature of refrigerant (at point d) between the second heat exchange section 42 and the first heat exchange section 41 may be provided. The degree of superheat of the refrigerant at the outlet of the first heat exchange section 41 is calculated based on the difference between the temperature of refrigerant at point e and that at point d. Thereby, the refrigerant in the first heat exchange section 41 can be completely evaporated in the heating operation. Thus, the heat exchanger can be effectively used, whereby a refrigeration cycle can be highly efficiently operated.

The flow control device 80 may double as the pressure reducing device 13 in the refrigerant circuit 10. In this case, the third heat exchange section 43 of the outdoor heat exchanger 14 is located closer to the indoor heat exchanger 12 than the pressure reducing device 13 in the refrigerant circuit 10 as illustrated in FIG. 1. Furthermore, a pressure reducing device 13 other than the flow control device 80 may be provided upstream of the third heat exchange section 43 in the refrigerant circulating direction in the heating operation. In this case, the opening degree of the pressure reducing device 13 in the heating operation is adjusted such that the temperature of the refrigerant which flows into the third heat exchange section 43 is higher than the temperature of the outdoor air (which may also be hereinafter referred to as "outside air temperature"). As the flow control device 80, a fixed expansion device may also be used.

The first heat exchange section 41, the second heat exchange section 42 and the third heat exchange section 43 each include one or more heat transfer tubes. In the following description, the number of heat transfer tubes included in each of the first heat exchange section 41, the second heat exchange section 42 and the third heat exchange section 43 will also be referred to as "the number of heat-transfer-tube stages". For example, if the number of heat transfer tubes included in the first heat exchange section 41 is n, the number of heat-transfer-tube stages in the first heat exchange section 41 is n. Furthermore, the first heat exchange section 41, the second heat exchange section 42 and the third heat exchange section 43 share the plate-like fins. However, the plate-like fins in the first heat exchange section 41 and the second heat exchange section 42 may be physically or thermally separated from those in the third heat exchange section 43. Thereby, it is possible to prevent thermal interference between the third heat exchange section 43 and the first and second heat exchange sections 41 and 42.

Figure 3:
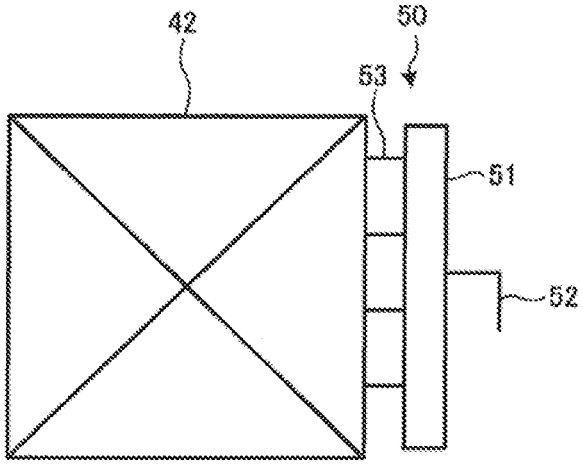
FIG. 3 is a schematic front view illustrating an example of a distributor connected to a second heat exchange section 42 of the outdoor heat exchanger 14 in embodiment 1 of the present invention.

FIG. 3 is a schematic front view illustrating an example of a distributor connected to the second heat exchange section 42 of the outdoor heat exchanger 14 in embodiment 1. A distributor 50 as illustrated in FIG. 3 includes a hollow header 51, which is, for example, part of the header collecting pipe, a single inflow pipe 52 connected to the hollow header 51, and a plurality of branch pipes 53 (the number of which is four in embodiment 1) connected to the hollow header 51. The branch pipes 53 are connected to ends of the heat transfer tubes in the second heat exchange section 42, which are located on one side of the heat transfer tubes. Thereby, after flowing into the hollow header 51 through the inflow pipe 52, refrigerant is distributed to a plurality of refrigerant passages in the second heat exchange section 42.

Figure 4:
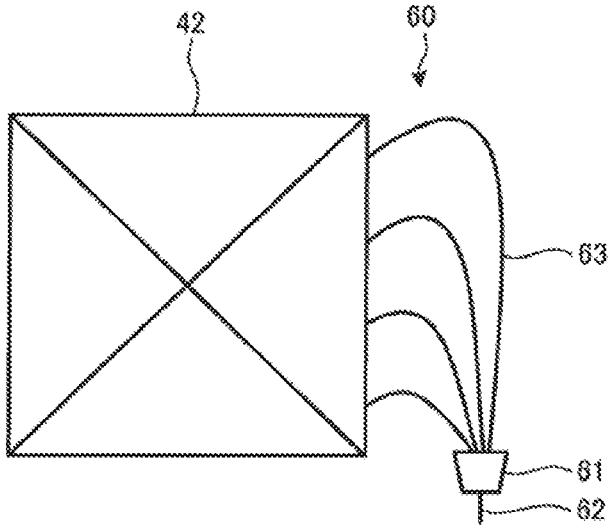
FIG. 4 is a schematic front view illustrating another example of the distributor connected to the second heat exchange section 42 of the outdoor heat exchanger 14 in embodiment 1 of the present invention.

FIG. 4 is a schematic front view illustrating another example of the distributor connected to the second heat exchange section 42 of the outdoor heat exchanger 14 in embodiment 1. A distributor 60 as illustrated in FIG. 4 includes a distributor body 61, a single inflow pipe 62 connected to the distributor body 61, and a plurality of capillary tubes 63 (the number of which is four in embodiment 1) connected to the distributor body 61. The capillary tubes 63 are connected to ends of the heat transfer tubes of the second heat exchange section 42, which are located on one side of the heat transfer tubes. Thereby, after flowing into the distributor body 61 through the inlet pipe 62, refrigerant is distributed to a plurality of refrigerant passages in the second heat exchange section 42.

Figure 5:
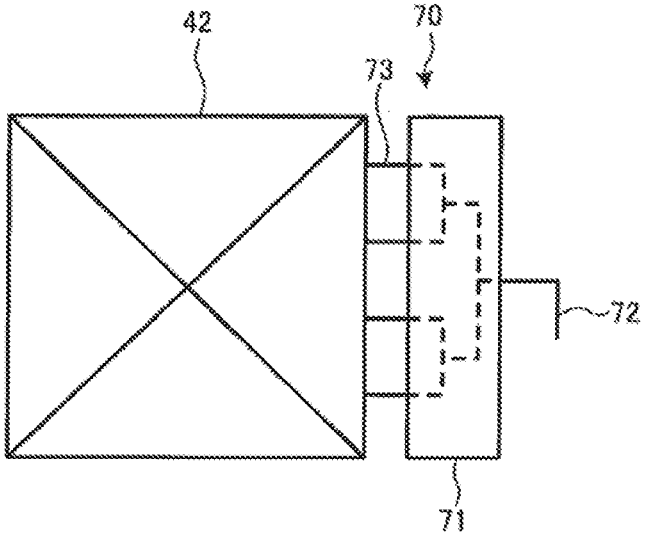
FIG. 5 is a schematic front view illustrating a further example of the distributor connected to the second heat exchange section 42 of the outdoor heat exchanger 14 in embodiment 1 of the present invention.

FIG. 5 is a schematic front view illustrating a further example of the distributor connected to the second heat exchange section 42 of the outdoor heat exchanger 14 in embodiment 1. A distributor 70 as illustrated in FIG. 5 is a stacked-type header distributor including a stacked-type header 71 having distribution passages, an inflow pipe 72 connected to the stacked-type header 71, and a plurality of branch pipes 73 (the number of which is four in embodiment 1) connected to the stacked-type header 71. In the stacked-type header 71, a plurality of plates which include plates provided with S-shaped or Z-shaped through grooves and plates provided with circular through holes are stacked together (see, for example, International Publication No, WO 2015/063857). The branch pipes 53 are connected to ends of the heat transfer tubes in the second heat exchange section 42, which are located on one side of the heat transfer tubes, Thereby, after flowing into the stacked-type header 71 through the inflow pipe 72, refrigerant is distributed to a plurality of refrigerant passages in the second heat exchange section 42.

Since any of the distributors 50, 60 and 70 as illustrated in FIGS. 3 to 5 is provided, a plurality of refrigerant passages parallel to each other are provided in the second heat exchange section 42. In all the configurations as illustrated in FIGS. 3 to 5, the number of refrigerant passages (the number of paths) in the second heat exchange section 42 is four. For example, in the heating operation, after flowing out of the first heat exchange section 41, the refrigerant is distributed to a plurality of flow passages by the distributor, and flows into the plurality of refrigerant passages in the second heat exchange section 42. In such a manner, since the refrigerant is distributed to the plurality of refrigerant passages, the flow velocity of the refrigerant is reduced, and the flow loss is thus reduced, as a result of which the refrigeration cycle can be operated with a high efficiency.

Although it is not illustrated, the first heat exchange section 41 and the third heat exchange section 43 are also connected to respective distributors which are different from the distributors 50, 60 and 70 in the number of distribution pipes, as occasion demands.

In embodiment 1, of the first heat exchange section 41, the second heat exchange section 42 and the third heat exchange section 43, the first heat exchange section 41 includes the largest number of refrigerant passages, the second heat exchange section 42 includes the second largest number of refrigerant passages, and the third heat exchange section 43 includes the smallest number of refrigerant passages. In other words, the numbers of refrigerant passages in the outdoor heat exchanger 14 satisfy the following relationship: the number of refrigerant passages in the first heat exchange section 41 is larger than the number of refrigerant paths in the second heat exchange section 42, which is larger than the number of refrigerant paths in the third heat exchange section 43. In the heating operation in which the first heat exchange section 41 and the second heat exchange section 42 of the outdoor heat exchanger 14 each serve as an evaporator, refrigerant in the first heat exchange section 41 has higher quality than that in the second heat exchange section 42. Thus, in the case where the flow velocity of the refrigerant in the first heat exchange section 41 is equal to that in the second heat exchange section 42, a pressure loss in the first heat exchange section 41 is greater than that in the second heat exchange section 42. By contrast, in embodiment 1, since the number of refrigerant passages in the first heat exchange section 41 is larger than that in the second heat exchange section 42, the pressure loss in the first heat exchange section 41 can be reduced, thus improving the operation efficiency of the refrigeration cycle.

In embodiment 1, in the refrigerant passages, the same number of heat transfer tubes are provided. Therefore, the first heat exchange section 41 includes the largest number of heat-transfer-tube stages, the second heat exchange section 42 includes the second largest number of heat-transfer-tube stages, and the third heat exchange section 43 includes the smallest number of heat-transfer-tube stages. In other words, the numbers of heat-transfer-tube stages in the outdoor heat exchanger 14 satisfy the following relationship: the number of heat-transfer-tube stages in the first heat exchange section 41 is larger than the number of heat-transfer-tube stages in the second heat exchange section 42, which is larger than the number of heat-transfer-tube stages in the third heat exchange section 43. As will be described later, the first heat exchange section 41 and the second heat exchange section 42 each serve as an evaporator in the heating operation, whereas the third heat exchange section 43 does not serve as an evaporator. In embodiment 1, the number of heat-transfer-tube stages in the third heat exchange section 43 is smaller than that in each of the first heat exchange section 41 and the second heat exchange section 42. It is therefore possible to reduce lowering of the heat exchange performance of the outdoor heat exchanger 14 operating as an evaporator.

Furthermore, in embodiment 1, the pressure loss in the first heat exchange section 41 is the smallest, the pressure loss in the second heat exchange section 42 is the second smallest, and the pressure loss in the third heat exchange section 43 is the greatest. That is, the pressure losses in the outdoor heat exchanger 14 satisfy the following relationship: the pressure loss in the first heat exchange section 41 is smaller than the pressure loss in the second heat exchange section 42, which is smaller than the pressure loss in the third heat exchange section 43.

Figure 6:
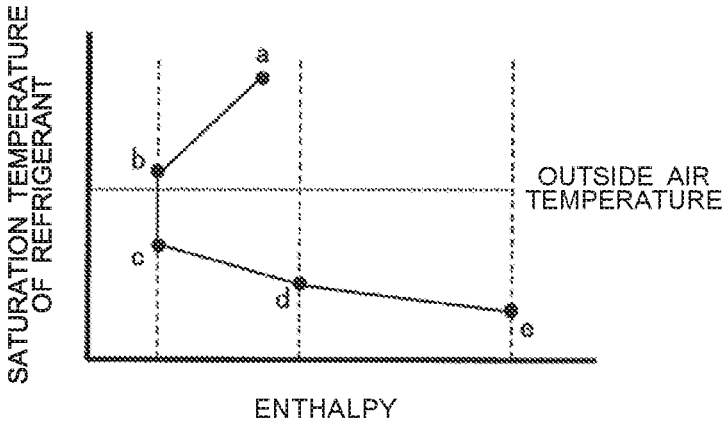
FIG. 6 is a graph indicating a relationship between the saturation temperature and enthalpy of refrigerant which flows through the outdoor heat exchanger 14 in embodiment 1 of the present invention.

An operation of the refrigerant circuit 10 will be described mainly by referring to the outdoor heat exchanger 14. FIG. 6 is a graph indicating a relationship between the saturation temperature and enthalpy of refrigerant which flows in the outdoor heat exchanger 14 in embodiment 1. In the graph, the vertical axis represents the saturation temperature of the refrigerant, and the horizontal axis represents the enthalpy. Also, in the graph, points a to e correspond to points a to e indicated in FIG. 2. FIG. 6 indicates the state of the refrigerant in the heating operation.

In the heating operation, the refrigerant flows through points a to e in this order and is then sucked into the compressor 11. The refrigerant at an inlet (point a) of the third heat exchange section 43 has a temperature higher than the outside air temperature. This refrigerant is in a single-phase liquid state in which it is condensed by, for example, the indoor heat exchanger 12. When the refrigerant flows into the third heat exchange section 43, it is cooled by exchanging heat with the outdoor air. Thereby, the enthalpy of the refrigerant lowers (point b). To be more specific, in the heating operation, the third heat exchange section 43, which is part of the outdoor heat exchanger 14, serves as a radiator, not an evaporator. After the refrigerant passes through the third heat exchange section 43, the pressure of the refrigerant is reduced by the pressure loss in the third heat exchange section 43.

After flowing out of the third heat exchange section 43, the refrigerant flows into the flow control device 80. In the flow control device 80, the pressure of the refrigerant is enthalpically reduced, and as a result the temperature of the refrigerant is lower than the outside air temperature (point c).

After flowing out of the flow control device 80, the refrigerant flows into the second heat exchange section 42. In the second heat exchange section 42, the refrigerant is heated by exchanging heat with the outdoor air. As a result, the enthalpy of the refrigerant increases (point d). After flowing out of the second heat exchange section 42, the refrigerant flows into the first heat exchange section 41. In the first heat exchange section 41, the refrigerant is further heated by exchanging heat with the outdoor air, Thereby, the enthalpy of the refrigerant further increases (point e), and the refrigerant changes into gas refrigerant, and then flows out of the first heat exchange section 41. That is, in the heating operation, the second heat exchange section 42 and the first heat exchange section 41 each serve as an evaporator. After flowing out of the first heat exchange section 41, the gas refrigerant is sucked by the compressor 11, and compressed thereby.

As described above, the refrigeration cycle apparatus according to embodiment 1 includes the refrigerant circuit 10 which allows the refrigerant to circulate therethrough, and the outdoor heat exchanger 14 which is provided at the refrigerant circuit 10 to exchange heat between the refrigerant and the outdoor air. The outdoor heat exchanger 14 includes the first heat exchange section 41, the second heat exchange section 42 and the third heat exchange section 43, which are connected in series in the refrigerant circuit 10. The second heat exchange section 42 is located below the first heat exchange section 41, and is connected thereto. The third heat exchange section 43 is located below the second heat exchange section 42, and is connected thereto. In the refrigerant passage 46 connecting the second heat exchange section 42 to the third heat exchange section 43, the flow control device 80 (an example of a pressure reducing device) is provided to reduce the pressure of refrigerant which flows through a refrigerant passage. In an operation mode (for example, a heating operation mode) in which the first heat exchange section 41 and the second heat exchange section 42 each serve as an evaporator, the third heat exchange section 43 is located at a position upstream than the position of the second heat exchange section 42 (for example, at a position upstream than the positions of both the first heat exchange section 41 and the second heat exchange section 42) in the refrigerant circulating direction (for example, in the flow of the refrigerant from discharging of the refrigerant from the compressor 11 to sucking of the refrigerant by the compressor 11). Also, in this operation mode, refrigerant having a temperature higher than the outside air temperature flows in the third heat exchange section 43.

In the heating operation, the first heat exchange section 41 and the second heat exchange section 42 of the outdoor heat exchanger 14 each serve as an evaporator. Thus, when the outside air temperature is low (for example, 2 degrees C. or less), moisture in air deposits as frost on the fins of the first heat exchange section 41 and the second heat exchange section 42. Therefore, in the case where the heating operation is performed under a condition wherein the outside air temperature is low, the heating operation is temporarily stopped, and a defrosting operation to melt frost at the first heat exchange section 41 and the second heat exchange section 42 is periodically performed. The defrosting operation is performed, for example, by switching the flow switching device 15 to thereby provide a flow passage similar to that in the cooling operation, and causing each of the first heat exchange section 41 and the second heat exchange section 42 to serve as a condenser. Water obtained by melting the frost in the defrosting operation collects at the third heat exchange section 43, which is located (for example, in the lowermost part of the outdoor heat exchanger 14) under the first heat exchange section 41 and the second heat exchange section 42. In the heating operation, in the third heat exchange section 43, the refrigerant having a temperature higher than the outside air temperature flows. Thus, even in the case where the heating operation is resumed under a condition where water obtained by melting frost stays at the third heat exchange section 43, lower part of the outdoor heat exchanger 14 can be prevented from freezing. It is therefore possible to prevent the outdoor heat exchanger 14 from being broken.

Embodiment 2

Figure 7:
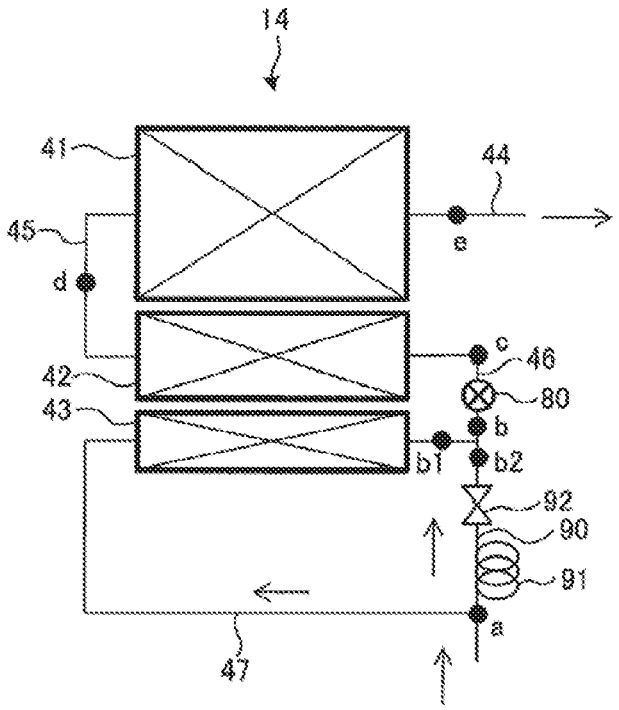
FIG. 7 is a schematic front view illustrating a configuration of an outdoor heat exchanger 14 in embodiment 2 of the present invention.

A refrigeration cycle apparatus according to embodiment 2 of the present invention will be described. FIG. 7 is a schematic front view illustrating a configuration of the outdoor heat exchanger 14 in embodiment 2. In FIG. 7, arrows each indicate the refrigerant circulating direction refrigerant in the heating operation. It should be noted that components having the same functions and operations as those in embodiment 1 will be denoted by the same reference signs, and their descriptions will thus be omitted.

As illustrated in FIG. 7, in embodiment 2, a bypass passage 90 is provided which bypasses the third heat exchange section 43 and connects the refrigerant passage 47 located on an inlet side of the third heat exchange section 43 in the heating operation to the refrigerant passage 46 located on an outlet side of the third heat exchange section 43 in the heating operation. In the bypass passage 90, a flow resistor 91 and an opening/closing valve 92 are provided; and the flow resistor 91 increases a resistance to the refrigerant circulating direction in the bypass passage 90, and the opening/closing valve 92 is controlled to be opened/closed by the controller. The flow resistor 91 includes a capillary tube or a pipe having a smaller inside diameter than a refrigerant pipe forming the bypass passage 90. As the opening/closing valve 92, a flow-rate adjustment valve which adjusts the flow rate of the refrigerant through the bypass passage 90 in a stepwise manner or continuously may be used.

Figure 8:
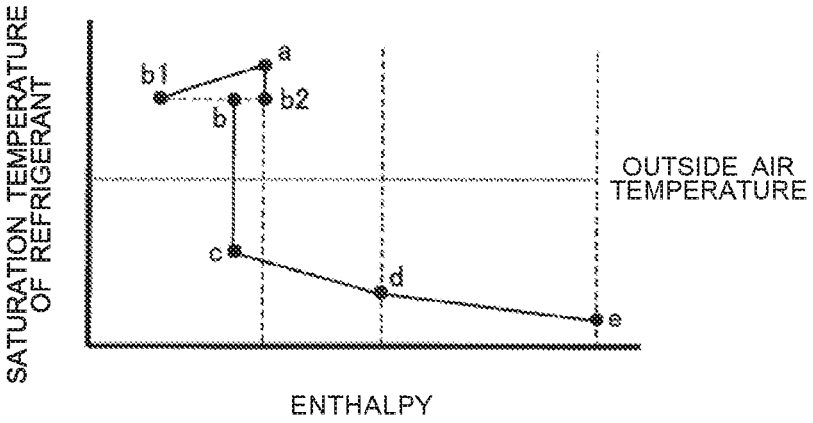
FIG. 8 is a graph indicating a relationship between the saturation temperature and enthalpy of refrigerant which flows through the outdoor heat exchanger 14 in embodiment 2 of the present invention.

FIG. 8 is a graph indicating a relationship between the saturation temperature and enthalpy of the refrigerant flowing in the outdoor heat exchanger 14 in embodiment 2. In the graph, points a toe and points b1 and b2 correspond to points a toe and points b1 and b2 illustrated in FIG. 7. FIG. 8 shows the state of the refrigerant in the heating operation.

In the heating operation, the opening/closing valve 92 is controlled to be opened. At point a in FIG. 7, the refrigerant flowing in the refrigerant passage 47 is divided into refrigerant which will flow toward the third heat exchange section 43 and refrigerant which will flow through the bypass passage 90. The refrigerant having flowed into the third heat exchange section 43 has a temperature higher than the outside air temperature, and is thus cooled by exchanging heat with the outdoor air. Thereby, the enthalpy of the refrigerant lowers (point b1 in FIG. 8). Also, when the refrigerant passes through the third heat exchange section 43, the pressure of the refrigerant is reduced by the pressure loss in the third heat exchange section 43.

By contrast, the pressure of the refrigerant having flowed into the bypass passage 90 is reduced by the flow resistor 91 and the opening/closing valve 92 (point b2). This pressure reduction is isenthalpically carried out because heat exchange is not performed in the bypass passage 90.

The refrigerant having passed through the third heat exchange section 43 and the refrigerant having passed through the bypass passage 90 join each other at a location (point b) upstream of the flow control device 80 to form single refrigerant. Then, the single refrigerant flows into the flow control device 80, and the pressure of the refrigerant is isenthalpically reduced therein. Thereby, the temperature of the refrigerant is lower than the outside air temperature (point c).

After flowing out of the flow control device 80, the refrigerant flows into the second heat exchange section 42 and then into the first heat exchange section 41, and the state of the refrigerant varies in the same manner (points d and e) as in embodiment 1.

In the cooling operation, the opening/closing valve 92 may be controlled to be in the closed state. Thereby, the entire refrigerant flows in the first heat exchange section 41, the second heat exchange section 42 and the third heat exchange section 43 in that order. However, in the case where the temperature of the refrigerant flowing through the third heat exchange section 43 is lower than the outside air temperature, the opening/closing valve 92 may be controlled to be in the opened state.

In embodiment 2, since the bypass passage 90 bypassing the third heat exchange section 43 is provided, the pressure of the refrigerant can be prevented from being excessively reduced in the third heat exchange section 43. Thereby, it is possible to increase the difference in pressure between an inlet and an outlet of the flow control device 80. As a result, a range within which the flow control device 80 can adjust the flow rate can be increased, and the flow control device 80 can be made smaller in capacity and size.

Furthermore, in the heating operation, the transfer amount of heat in the third heat exchange section 43 can be reduced, thus preventing excessive reduction of enthalpy at point c in FIG. 8. It is therefore possible to reduce an evaporation load at each of the second heat exchange section 42 and the first heat exchange section 41. Thus, it is possible to reduce lowering of the saturation temperature of the refrigerant at the outlet of the first heat exchange section 41, thus improving the operation efficiency of the refrigeration cycle.

Embodiment 3

Figure 9:
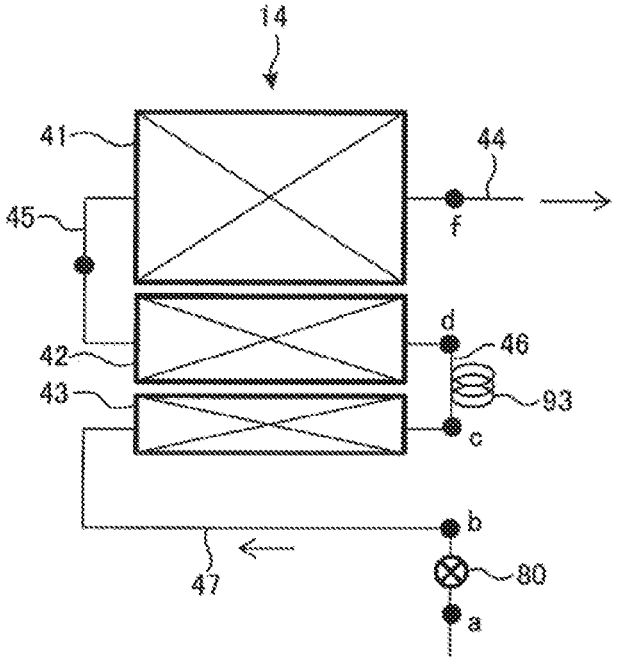
FIG. 9 is a schematic front view illustrating a configuration of an outdoor heat exchanger 14 in embodiment 3 of the present invention.

A refrigeration cycle apparatus according to embodiment 3 of the present invention will be described. FIG. 9 is a schematic front view illustrating a configuration of the outdoor heat exchanger 14 in embodiment 3. In FIG. 9, arrows each indicate the refrigerant circulating direction in the heating operation. It should be noted that components having the same functions and operations as those in embodiment 1 or 2 will be denoted by the same reference signs, and their descriptions will thus be omitted.

As illustrated in FIG. 9, in third embodiment 1, the flow control device 80 (an example of a pressure reducing device) is provided upstream of the third heat exchange section 43 in the heating operation. As the flow control device 80, for example, an electronic expansion valve is used. Furthermore, a flow resistor 93 (an example of a pressure reducing device) is provided at the refrigerant passage 46 between the third heat exchange section 43 and the second heat exchange section 42. The flow resistor 93 is formed of, for example, a capillary tube or a pipe having a smaller inside diameter than the refrigerant pipe which forms the bypass passage 90. Alternatively, for example, the distributor 60 as illustrated in FIG. 4 or the distributor 70 as illustrated in FIG. 5 can be used as the flow resistor 93. In this case, the flow resistor 93 has a refrigerant distributing function of distributing the refrigerant to a plurality of refrigerant passages.

Figure 10:
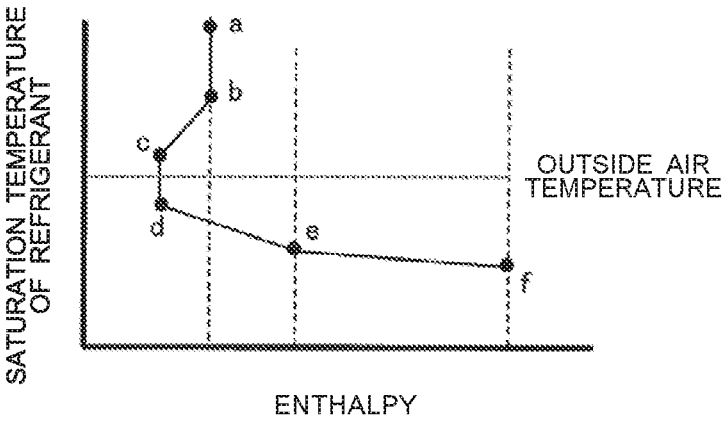
FIG. 10 is a graph indicating a relationship between the saturation temperature and enthalpy of refrigerant which flows through the outdoor heat exchanger 14 in embodiment 3 of the present invention.

FIG. 10 is a graph indicating a relationship between the saturation temperature and enthalpy of the refrigerant flowing through the outdoor heat exchanger 14 in embodiment 3. In the graph, points a to f correspond to points a to f indicated in FIG. 9. FIG. 10 indicates the state of the refrigerant in the heating operation.

As illustrated in FIG. 10, in the heating operation, the refrigerant having a temperature (point a in FIG. 10) higher than the outside air temperature flows into the flow control device 80. In the flow control device 80, the pressure of the refrigerant is isenthalpically reduced (point b). The refrigerant having flowed out of the flow control device 80 has a temperature higher than the outside air temperature.

After flowing out of the flow control device 80, the refrigerant flows into the third heat exchange section 43. In the third heat exchange section 43, the refrigerant is cooled by exchanging heat with the outdoor air, since it has a temperature higher than the outside air temperature, the refrigerant is cooled by exchanging heat with the outdoor air. Thereby, the enthalpy of the refrigerant lowers (point c). Furthermore, the pressure of the refrigerant that has passed through the third heat exchange section 43 is reduced by a pressure loss in the third heat exchange section 43.

After flowing out of the third heat exchange section 43, the refrigerant flows into the flow resistor 93, and the pressure of the refrigerant is isenthalpically reduced. Thus, the temperature of the refrigerant is lower than the outside air temperature (point d).

After flowing out of the flow resistor 93, the refrigerant flows into the second heat exchange section 42 and the first heat exchange section 41, and the state of the refrigerant varies in the same manner (points e and f) as in embodiment 1.

In embodiment 3, the difference between the temperature (temperature at point b) of the refrigerant which flows into the third heat exchange section 43 and the outside air temperature is smaller than that in embodiment 1. Thus, the transfer amount of heat at the third heat exchange section 43 (or the difference between enthalpy at point b and that at point c) can be reduced. Thus, it is possible to reduce an evaporation load in each of the second heat exchange section 42 and the first heat exchange section 41, thus improving the operation efficiency of the refrigeration cycle.

In embodiment 3, the flow resistor 93 can be easily attached to the outdoor heat exchanger 14, and the flow resistor 93 and the outdoor heat exchanger 14 can be easily unitized. Therefore, in the manufacturing process of the outdoor unit 22, the workability of connection of the outdoor heat exchanger 14 can be improved.

In the cooling operation in which the first heat exchange section 41 and the second heat exchange section 42 each serve as a condenser, the refrigerant flowing through the third heat exchange section 43 is in an almost liquid state, and the pressure loss is thus small. Furthermore since the refrigerant has a temperature higher than the outside air temperature, the refrigerant is cooled by the outdoor air.

Embodiment 4

Figure 11:
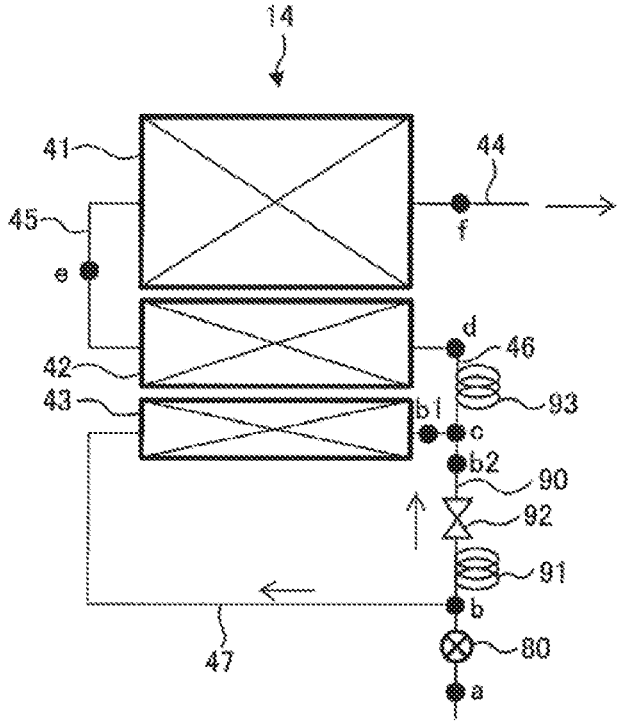
FIG. 11 is a schematic front view illustrating the configuration of the outdoor heat exchanger 14 in embodiment 4 of the present invention.

A refrigeration cycle apparatus according to embodiment 4 of the present invention will be described. FIG. 11 is a schematic front view illustrating a configuration of the outdoor heat exchanger 14 in embodiment 4. In FIG. 11, arrows each indicate the refrigerant circulating direction in the heating operation. It should be noted that components having the same functions and operations as those in any of embodiments 1 to 3 will be denoted by the same reference signs and their descriptions will thus be omitted.

As illustrated in FIG. 11, the flow control device 80 is provided upstream of the third heat exchange section 43 in the heating operation. Also, the flow resistor 93 is provided at the refrigerant passage 46 between the third heat exchange section 43 and the second heat exchange section 42. Furthermore, the bypass passage 90 is provided, and connects the refrigerant passage 47 located on the inlet side of the third heat exchange section 43 in the heating operation and the refrigerant passage 46 located on the outlet side of the third heat exchange section 43 in the heating operation, without extending through the third heat exchange section 43. At the bypass passage 90, the flow resistor 91 and the opening/closing valve 92 are provided.

Figure 12:
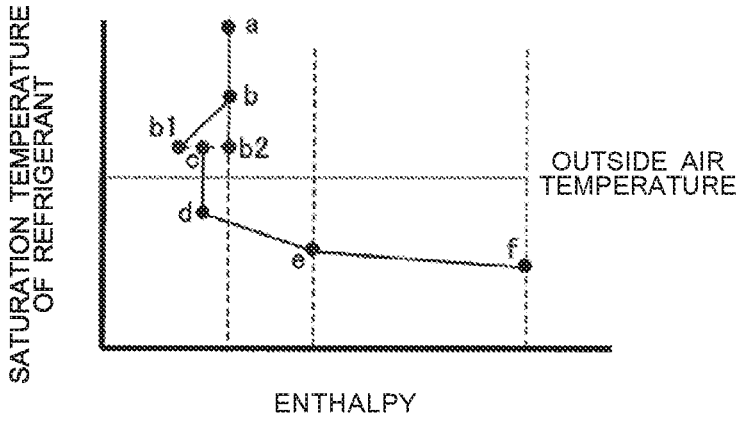
FIG. 12 is a graph indicating a relationship between the saturation temperature and enthalpy of refrigerant which flows through an outdoor heat exchanger 14 in embodiment 4 of the present invention.

FIG. 12 is a graph showing a relationship between the saturation temperature and enthalpy of the refrigerant flowing through the outdoor heat exchanger 14 in embodiment 4. In the graph, points a to f and points b1 and b2 correspond to points a to f and points b1 and b2 indicated in FIG. 11. FIG. 12 indicates the state of the refrigerant in the heating operation.

As illustrated in FIG. 12, in the heating operation, refrigerant having a temperature (point a in FIG. 12) higher than the outside air temperature flows into the flow control device 80. In the flow control device 80, the pressure of the refrigerant is isenthalpically reduced (point b). The refrigerant have flowed out of the flow control device 80 has a temperature higher than the outside air temperature.

In the heating operation, the opening/closing valve 92 is controlled to be in the opened state. Thereby, after flowing out of the flow control device 80, the refrigerant is divided into refrigerant which will flow into a passage extending through the third heat exchange section 43 and refrigerant which will flow into the bypass passage 90. Since the refrigerant which has flowed into the third heat exchange section 43 has a temperature higher than the outside air temperature, the refrigerant is cooled by exchanging heat with the outdoor air. Thus, the enthalpy of the refrigerant lowers (point b1), Furthermore, the pressure of the refrigerant which has passed through the third heat exchange section 43 is reduced by the pressure loss in the third heat exchange section 43.

By contrast, the pressure of the refrigerant having flowed into the bypass passage 90 is reduced (point b2) by the flow resistor 91 and the opening/closing valve 92. Since heat exchange is not performed in the bypass passage 90, this pressure reduction is isenthalpic.

The refrigerant having passed through the third heat exchange section 43 and the refrigerant having passed through the bypass passage 90 join each other at a location (point c) upstream of the flow control device 80. After these refrigerants are combined into a single refrigerant in such a manner, the single refrigerant flows into the flow resistor 93. In the flow resistor 93, the pressure of the refrigerant is isenthalpically reduced. Thus, the temperature of the refrigerant is lower than the outside air temperature (point d).

After flowing out of the flow resistor 93, the refrigerant flows into the second heat exchange section 42 and the first heat exchange section 41, and the state of the refrigerant varies in the same manner (points e and f) as in embodiment 1.

In the cooling operation, the opening/closing valve 92 may be controlled to be in the closed state. Thereby, the entire refrigerant flows through the first heat exchange section 41, the second heat exchange section 42 and the third heat exchange section 43 in that order.

In embodiment 4, since the bypass passage 90 bypassing the third heat exchange section 43 is provided, the pressure loss in the third heat exchange section 43 can be reduced. Thereby, the difference in pressure between the inlet and the outlet of the flow control device 80 can be increased. A range within which the flow control device 80 can adjust the flow rate can be increased, and the flow control device 80 can be made smaller in capacity and size.

Furthermore, in embodiment 4, in the cooling operation, the entire amount of refrigerant can be made to flow into the third heat exchange section 43, thus increasing the amount of heat exchange in the outdoor heat exchanger 14. However, in the case where the pressure loss in the third heat exchange section 43 is great, the opening/closing valve 92 may be controlled to be in the opened state, thereby causing part of the refrigerant or the entire refrigerant to flow into the bypass passage 90.

Embodiment 5

Figure 13:
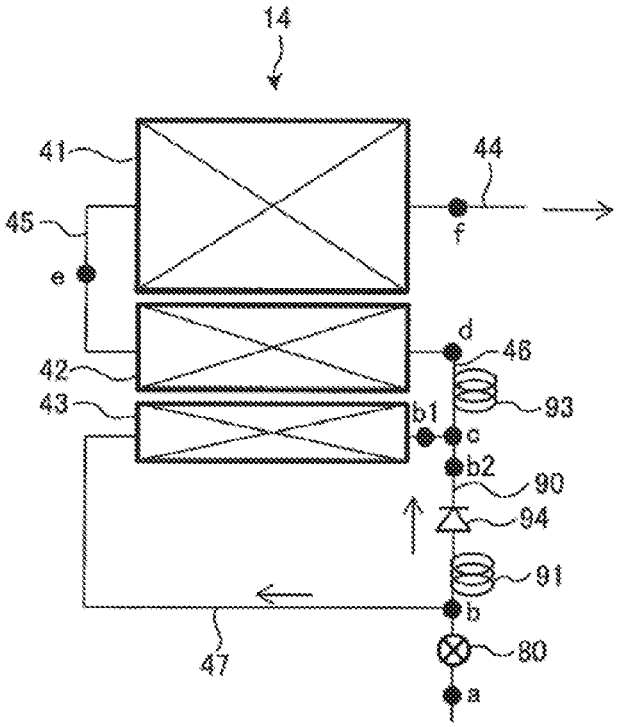
FIG. 13 is a schematic front view illustrating a configuration of an outdoor heat exchanger 14 in embodiment 5 of the present invention.

A refrigeration cycle apparatus according to embodiment 5 of the present invention will be described. FIG. 13 is a schematic front view illustrating a configuration of the outdoor heat exchanger 14 in embodiment 5. In FIG. 13, arrows each indicate the refrigerant circulating direction in the heating operation. Components having the same functions and operations as those in any of embodiments 1 to 4 will be denoted by the same reference signs, and their descriptions will thus be omitted.

As illustrated in FIG. 13, in embodiment 5, the refrigeration cycle apparatus includes a check valve 94 instead of the opening/closing valve 92. In this regard, embodiment 5 is different from embodiment 4. The check valve 94 allows the refrigerant in the bypass passage 90 to flow in a direction from the flow control device 80 toward the second heat exchange section 42, and inhibits the refrigerant from flowing in the opposite direction to the above direction. That is, during the heating operation, the check valve 94 allows flowing of the refrigerant, and during the cooling operation, the check valve 94 inhibits flowing of the refrigerant.

Figure 14:
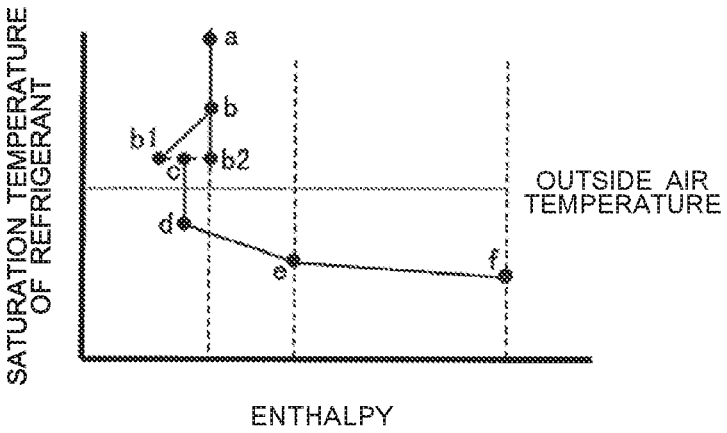
FIG. 14 is a graph indicating a relationship between the saturation temperature and enthalpy of refrigerant which flows through an outdoor heat exchanger 14 in embodiment 5 of the present invention.

FIG. 14 is a graph showing a relationship between the saturation temperature and enthalpy of the refrigerant flowing through the outdoor heat exchanger 14 in embodiment 5. In the graph, points a to f and points b1 and b2 correspond to points a to f and points b1 and b2 indicated in FIG. 13. The graph of FIG. 14 is the same as that of FIG. 12, and its description will thus be omitted.

In embodiment 5, the check valve 94 is provided instead of the opening/closing valve 92. Therefore, the manufacturing cost of the refrigerant circuit 10 can be reduced as compared with that in embodiment 4.

Embodiment 6

Figure 15:
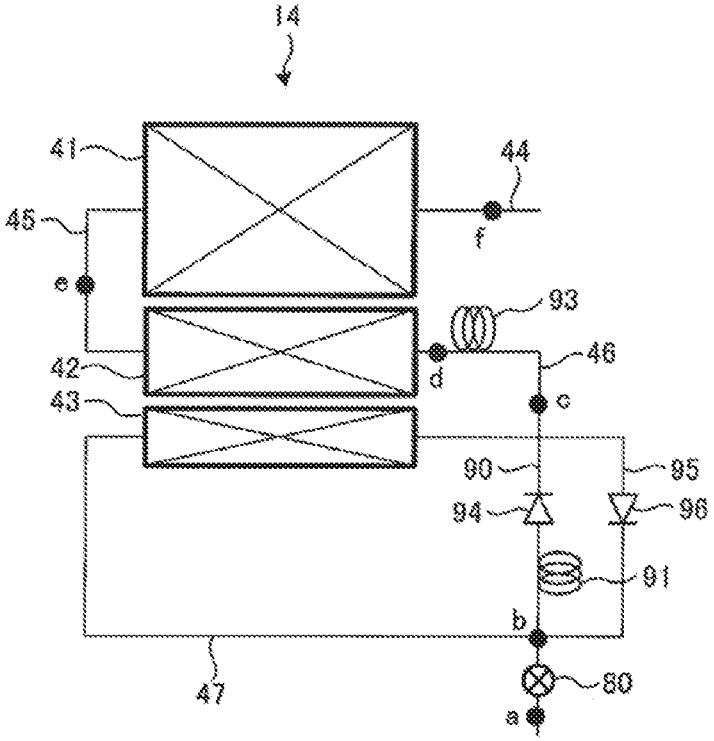
FIG. 15 is a schematic front view illustrating a configuration of an outdoor heat exchanger 14 in embodiment 6 of the present invention.

A refrigeration cycle apparatus according to embodiment 6 of the present invention will be described. FIG. 15 is a schematic front view illustrating a configuration of the outdoor heat exchanger 14 in embodiment 6. Components having the same functions and operations as those in any of embodiments 1 to 5 will be denoted by the same reference signs, and their descriptions will thus be omitted.

As illustrated in FIG. 15, in addition to the configuration according to embodiment 5, the refrigeration cycle apparatus according to embodiment 6 further includes another bypass passage, i.e., a bypass passage 95 other than the bypass passage 90. The bypass passage 95 connects the refrigerant passage 47 located on the inlet side of the third heat exchange section 43 in the heating operation and the refrigerant passage 46 located on the outlet side of the third heat exchange section 43 in the heating operation, without extending through the third heat exchange section 43. Also, the bypass passage 95 is located parallel to the bypass passage 90.

In the bypass passage 90, the flow resistor 91 and the check valve 94 are provided. In the bypass passage 95, a check valve 96 is provided. The check valve 96 allows the refrigerant in the bypass passage 95 to flow in a direction from the second heat exchange section 42 toward the flow control device 80, and inhibits the refrigerant from flowing in the opposite direction to the above direction. That is, during the cooling operation, the check valve 96 allows flowing of the refrigerant, and during the heating operation, the check valve 96 inhibits flowing of the refrigerant. Thus, the function of the check valve 96 is opposite to that of the check valve 94.

Figure 16:
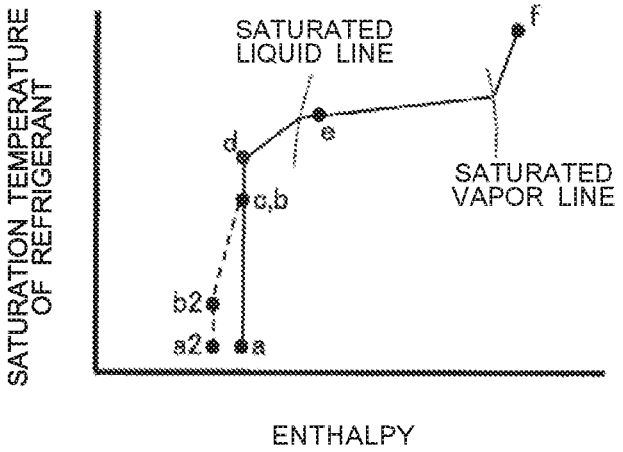
FIG. 16 is a graph indicating a relationship between the saturation temperature and enthalpy of refrigerant which flows through the outdoor heat exchanger 14 in embodiment 6 of the present invention.

FIG. 16 is a graph indicating a relationship between the saturation temperature and enthalpy of the refrigerant flowing through the outdoor heat exchanger 14 in embodiment 6. In the graph, points a to f correspond to points a to f illustrated in FIG. 15. FIG. 16 indicates the state of the refrigerant in the defrosting operation or the cooling operation in which the first heat exchange section 41 and the second heat exchange section 42 each serve as a condenser. Since the state of the refrigerant in the heating operation is the same as that in embodiment 5, its description will thus be omitted.

High-temperature, high-pressure refrigerant (point f in FIG. 16) discharged from the compressor 11 flows into the first heat exchange section 41 and the second heat exchange section 42. In the first heat exchange section 41 and the second heat exchange section 42, the refrigerant is cooled (points e and d) by exchanging heat with frost on the fins or the outdoor air. Thereby, in the defrosting operation, the refrigerant transfers heat to the frost, thus melting the frost. After flowing out of the second heat exchange section 42, the refrigerant flows into the flow resistor 93. In the flow resistor 93, the pressure of the refrigerant is isenthalpically reduced (point c).

After flowing out of the flow resistor 93, the refrigerant is divided into refrigerant which will flow into the passage extending through the third heat exchange section 43 and refrigerant which will flow into the bypass passage 95. In this case, most of the refrigerant flows through the bypass passage 95 (point b) because the check valve 96 has a smaller pressure loss than the third heat exchange section 43. The refrigerant which has passed through the third heat exchange section 43 and the refrigerant which has passed through the bypass passage 95 join each other at a location upstream of the flow control device 80. After those refrigerants are combined into a single refrigerant in the above manner, the single refrigerant flows into the flow control device 80, and the pressure of the refrigerant is isenthalpically reduced (point a).

In FIG. 16, a broken line indicates the state of the refrigerant in the case where the bypass passage 95 is not provided. In the case where the bypass passage 95 is not provided, the entire refrigerant which has flowed out of the flow resistor 93 flows into the third heat exchange section 43. The pressure of the refrigerant which has passed through the third heat exchange section 43 is reduced (point b2) by the pressure loss in the third heat exchange section 43, thus reducing the difference in pressure between the inlet and the outlet of the flow control device 80 (point a2).

In contrast, in embodiment 6, by virtue of provision of the bypass passage 95, it is possible to prevent the pressure of the refrigerant from being excessively lowered at the third heat exchange section 43. It is therefore possible to increase the difference in pressure between the inlet and the outlet of the flow control device 80. Thus, a range within which the flow control device 80 can adjust the flow rate can be increased, and the flow control device 80 can be made smaller in capacity and size.

Furthermore, in embodiment 6, the pressure of the refrigerant in the third heat exchange section 43 can be prevented from being excessively lowered, and the flow rate of the refrigerant in the defrosting operation can thus be increased. Therefore, the time required for the defrosting operation is shortened, thus improving the comfortability of the indoor space.

Embodiment 7

Figure 17:
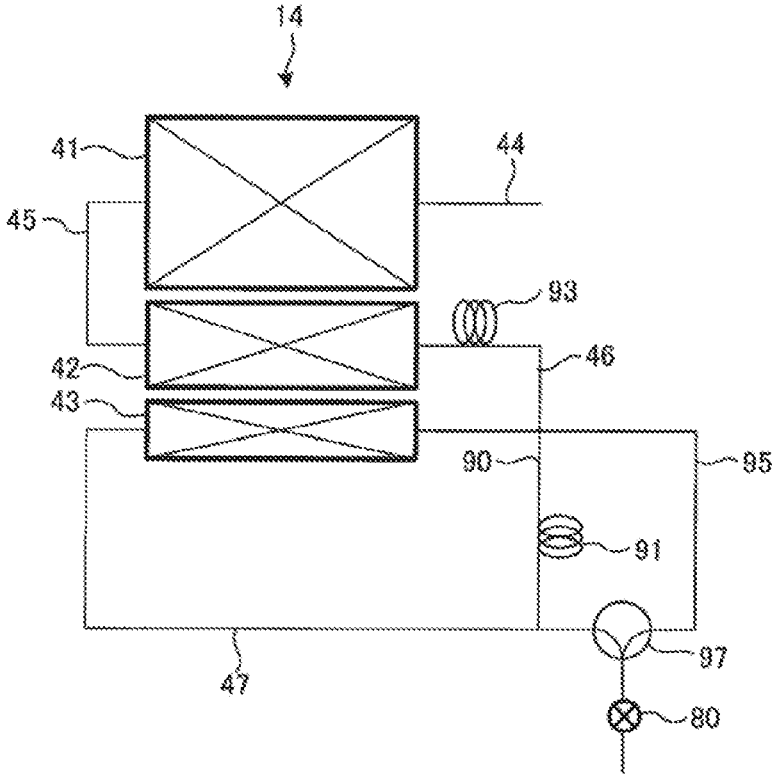
FIG. 17 is a schematic front view illustrating a configuration of an outdoor heat exchanger 14 in embodiment 7 of the present invention.

A refrigeration cycle apparatus according to embodiment 7 of the present invention will be described. FIG. 17 is a schematic front view illustrating a configuration of the outdoor heat exchanger 14 according to embodiment 7. Components having the same functions and operations as those in any of embodiments 1 to 6 will be denoted by the same reference signs, and their descriptions will thus be omitted.

As illustrated in FIG. 17, in embodiment 7, a three-way switching valve 97 is provided instead of the check valves 94 and 96. In this regard, embodiment 7 is different from embodiment 6. Under the control by the controller, the three-way switching device 97 switches the bypass passage for use in flowing of the refrigerant between the bypass passage 90 and the bypass passage 95. To be more specific, in the heating operation, switching of the three-way switching valve 97 is performed to cause the flow control device 80 to communicate with the third heat exchange section 43 and the bypass passage 90; and in the cooling operation, switching of the three-way switching valve 97 is performed to cause the flow control device 80 to communicate with the bypass passage 95.

In embodiment 7, the three-way switching valve 97 is used instead of the check valves 94 and 96, which are greatly restricted in what state they are installed. Thus, the structure of the pipes and peripheral elements thereof can be simplified, and the productivity of products is improved. Furthermore, since the three-way switching valve 97 is used in embodiment 7 instead of the check valves 94 and 96, which can cause chatter (vibration sound), the quality of the refrigeration cycle apparatus is enhanced. In addition, the use of the three-way switching valve 97 ensures reliable switching between the refrigerant passages, With respect to embodiment 7, although the three-way switching valve 97 is described above by way of example, a plurality of two-way valves can be used instead of the three-way switching valve 97.

The above embodiments can be put to practical use in combination.

REFERENCE SIGNS LIST

10 refrigerant circuit 11 compressor 12 indoor heat exchanger 13 pressure reducing device 14 outdoor heat exchanger 15 flow switching device 21 indoor unit 22 outdoor unit 31 indoor air-sending fan 32 outdoor air-sending fan 41 first heat exchange section 42 second heat exchange section 43 third heat exchange section 44, 45, 46, 47 refrigerant passage 50 distributor 51 hollow header 52 inlet pipe 53 distribution pipe 60 distributor 61 distributor body 62 inlet pipe 63 capillary tube 70 distributor 71 stacked-type header 72 inlet pipe 73 branch pipe 80 flow control device 90 bypass passage 91 flow resistor 92 on-off valve 93 flow resistor 94 check valve 95 bypass passage 96 check valve 97 three-way switching valve

The invention claimed is:

1. A refrigeration cycle apparatus comprising:

a refrigerant circuit allowing refrigerant to circulate therethrough; and an outdoor heat exchanger provided to the refrigerant circuit, and configured to exchange heat between the refrigerant and outdoor air, the outdoor heat exchanger having a first heat exchange section, a second heat exchange section, and a third heat exchange section, the second heat exchange section being located below the first heat exchange section and connected to the first heat exchange section, and the third heat exchange section being located below the second heat exchange section and connected to the second heat exchange section, the refrigerant circuit including a first pressure reducing valve provided to a refrigerant passage connecting the second heat exchange section and the third heat exchange section, the first pressure reducing valve being configured to reduce a pressure of the refrigerant passing therethrough, the refrigeration cycle apparatus performing an operation mode being operated with the first heat exchange section and the second heat exchange section serving as an evaporator, during the operation mode, the third heat exchange section being located at a position more upstream than a position of the second heat exchange section in a refrigerant circulating direction, the third heat exchange section allowing the refrigerant having a temperature higher than a temperature of the outdoor air to pass therethrough, wherein the second heat exchange section includes a number of refrigerant passages that is smaller than a number of refrigerant passages included in the first heat exchange section, and that is larger than a number of refrigerant passages included in the third heat exchange section, and wherein the refrigerant circuit includes a first bypass passage that connects a refrigerant passage located on an inlet side of the third heat exchange section and a refrigerant passage located on an outlet side of the third heat exchange section, without extending through the third heat exchange section, and a second bypass passage that connects the refrigerant passage located on the inlet side of the third heat exchange section and the refrigerant passage located on the outlet side of the third heat exchange section, without extending through the third heat exchange section, and the second bypass passage is parallel to the first bypass passage.

2. The refrigeration cycle apparatus of claim 1, wherein the second heat exchange section includes a number of heat-transfer-tube stages that is smaller than a number of heat-transfer-tube stages included in the first heat exchange section, and that is larger than a number of heat-transfer-tube stages included in the third heat exchange section.

3. The refrigeration cycle apparatus of claim 1, wherein in the first bypass passage, a flow resistor pipe and an opening/closing valve are provided.

4. The refrigeration cycle apparatus of claim 1, wherein in the first bypass passage, a flow resistor pipe and a check valve are provided.

5. The refrigeration cycle apparatus of claim 1, wherein the refrigerant circuit includes a switching valve configured to switch a bypass passage in which the refrigerant is to flow, between the first bypass passage and the second bypass passage.

6. The refrigeration cycle apparatus of claim 1, wherein the first pressure reducing valve has a refrigerant distributing function of distributing the refrigerant to a plurality of refrigerant passages.

7. The refrigeration cycle apparatus of claim 1, wherein the refrigerant circuit includes a second pressure reducing valve provided at a position more upstream than the position of the third heat exchange section in the refrigerant circulating direction in the operation mode.

* * * * *